US007135950B2

(12) United States Patent
Chang et al.

(10) Patent No.: US 7,135,950 B2
(45) Date of Patent: Nov. 14, 2006

(54) THIN TRANSFORMER

(75) Inventors: Gil-young Chang, Hwaseong-gun (KR); Kyoung-geun Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 92 days.

(21) Appl. No.: 10/867,747

(22) Filed: Jun. 16, 2004

(65) Prior Publication Data

US 2004/0257189 A1 Dec. 23, 2004

(30) Foreign Application Priority Data

Jun. 19, 2003 (KR) ..... 10-2003-0039888

(51) Int. Cl.
*H01F 27/30* (2006.01)
*H01F 27/29* (2006.01)

(52) U.S. Cl. ..... 336/192; 336/208; 336/212

(58) Field of Classification Search ..... 336/200, 336/212, 198, 192, 208
See application file for complete search history.

(56) References Cited

U.S. PATENT DOCUMENTS 5,034,854 A * 7/1991 Matsumura et al. ..... 361/744
6,480,085 B1 * 11/2002 Chiang et al. ..... 336/198
6,661,326 B1 * 12/2003 Yeh et al. ..... 336/208
6,714,111 B1 * 3/2004 Suzuki ..... 336/110
6,798,328 B1 * 9/2004 Uchiyama ..... 336/208

FOREIGN PATENT DOCUMENTS

| | | |
|---|---|---|
| JP | 5-326265 | 12/1993 |
| JP | 10-261525 | 9/1998 |
| KR | 1990-0003290 | 4/1990 |

OTHER PUBLICATIONS

Korean Office Action dated Aug. 26, 2005 for Korean Patent Application No. 10-2003-0039888.

* cited by examiner

*Primary Examiner*—Anh Mai
(74) *Attorney, Agent, or Firm*—Stanzione & Kim, LLP

(57) ABSTRACT

A thin transformer includes a hollow coil bobbin around which a coil is wound, an iron core provided to pass through a portion of the coil bobbin, and a terminal section having several terminals electrically connected to drawn-out lines of the coil and electrically and mechanically connected to a circuit board, the terminal section disposed adjacent to the coil bobbin below the iron core and provided at the terminal section such that a first portion of each terminal connected to a corresponding one of the drawn-out lines is exposed from a side surface of the terminal section other than a lower surface of the terminal section from which each terminal is exposed for connection to the circuit board. A plurality of grooves through which the drawn-out lines connected to the respective terminals can pass are formed on the terminal section. Accordingly, it is possible to decrease a total height of the transformer necessarily used for an electronic, thus accomplishing the decrease of a thickness and size of the electronic apparatus.

22 Claims, 4 Drawing Sheets

THIN TRANSFORMER

CROSS-REFERENCE TO RELATED APPLICATIONS

This application claims the priority of Korean Patent Application No. 2003-39888, filed on Jun. 19, 2003, in the Korean Intellectual Property Office, the disclosure of which is incorporated herein in its entirety by reference.

BACKGROUND OF THE INVENTION

1. Field of the Invention

The present general inventive concept relates to a thin transformer used in a power source of an electronic apparatus, and specifically, to a thin transformer having a decreased thickness so that the thin transformer is used in a limited space of a product, such an electronic apparatus.

2. Description of the Related Art

Decrease in thickness and size of various types of electronic equipment has been required and developed. For example, liquid crystal display apparatuses, such as liquid crystal televisions or liquid crystal monitors, become a main stream of display apparatuses because the liquid crystal display apparatuses have a merit that it is possible to largely decrease a thickness of a product to efficiently use spaces, compared with conventional display apparatuses employing cathode ray tubes.

On the other hand, since transformers which are components necessary for power sources of the electronic equipment are increased in size in proportional to capacities of the power sources, it is different to decrease the electronic equipments in thickness and size. Specifically, considering a modern trend that external appearances should be made simple and beautiful by building the power sources within the liquid crystal televisions and the liquid crystal monitors, the thickness of the transformers is an important factor to decrease the thickness of products, such as the liquid crystal televisions and the liquid crystal monitors. For this reason, studies for decreasing a height of the transformers have proceeded, and a horizontal transformer has been employed. In the horizontal transformer, a coil bobbin around which a coil is wound is provided not vertically but horizontally with respect to a circuit board on which the transformer is mounted.

FIG. 1 is a perspective view illustrating a conventional horizontal transformer, and FIG. 2 is a front view illustrating the conventional horizontal transformer of FIG. 1.

In FIGS. 1 and 2, a coil 1 is wound around a coil bobbin 3 which is a hollow body having restriction projections 2 at both ends thereof, and terminal sections 4 formed integrally or separately with the restriction projections 2 are provided below the restriction projections 2. The terminal section 4 includes several terminals 5 perpendicular to a lower surface of the terminal section 4, drawn-out lines 6 of the coil 1 are connected to the terminals 5, and two "E" shaped iron cores 7 are inserted into the coil bobbin 3 to be disposed opposite to each other with respect to the coil bobbin 3. A protruding portion 8 is formed on an edge of the terminal section 4, where the protruding portion 8 serves as preventing connection portions between the drawn-out lines 6 and the terminals 5 from coming in direct contact with a circuit board during mounting the transformer on the circuit board. Actually, the circuit board is positioned below the transformer, and the terminals 5 are coupled electrically and mechanically to the circuit board through the terminals.

Since the coil bobbin 3 is provided not vertically but horizontally, a height of the transformer can be decreased. However, in this conventional horizontal transformer, the terminals 5 for electrical and mechanical connection to the circuit board are provided vertically to the lower surface of the terminal section 4, and in order to secure a mechanical strength, the terminal section 4 must have a thickness corresponding to a sufficient length of the terminals 5 to be buried thereinto. That is, the height of the transformer can not be decreased. Rather, the height of the transformer becomes increased. In addition, the height of the transformer is further increased due to the protruding portion 8 serving as securing spaces for connection between the drawn-out lines 6 of the coil 1 and the terminals 5.

Therefore, the decrease of a total height of the conventional transformer with respect to the circuit board is restricted, and the decrease of the thickness and size of the electronic equipment in which the conventional transformer is used is also restricted according to the total height of the conventional transformer.

SUMMARY OF THE INVENTION

In order to solve the foregoing and/or other problems, it is an aspect of the present general inventive concept by providing a thin transformer with a decreased thickness.

It is another aspect of the present general inventive concept to provide a thin transformer having an improved structure of a terminal section and terminals to further decrease a thickness thereof.

Additional aspects and advantages of the present general inventive concept will be set forth in part in the description which follows and, in part, will be obvious from the description, or may be learned by practice of the general inventive concept.

The foregoing and/or other aspects of the present general inventive concept may be achieved by providing a thin transformer including a hollow coil bobbin around which a coil is wound, an iron core provided to pass through a hollow portion of the coil bobbin, and a terminal section having several terminals electrically connected to drawn-out lines of the coil, the terminal section electrically and mechanically connected to a circuit board and disposed adjacent to the coil bobbin below the iron core. The terminals are provided at the terminal section such that a portion of each terminal connected to a corresponding one of the drawn-out lines is exposed from a first position (side surface) of the terminal section other than a second position (lower surface) of the terminal section in which each terminal is exposed from the lower surface of the terminal section for connection to the circuit board. The terminal section includes grooves through which the drawn-out lines connected to the respective terminals can pass.

In an aspect of the present general inventive concept, the thin transformer may not need a conventional protruding portion, which is inevitably required to prevent a connection portion between the terminals and the drawn-out lines from coming in direct contact with the circuit board in a conventional transformer. In another aspect of the present general inventive concept, a height of the terminal section can be decreased by as much as a height of the protruding portion, thus accomplishing the decrease of the thickness of the thin transformer.

The foregoing and/or other aspects of the present general inventive concept may also be achieved by providing a thin transformer_used with an electronics apparatus having a circuit board, the thin transformer including a coil bobbin around which a coil is wound, the coil having a plurality of drawn-out lines, a core having a portion disposed around the coil and the coil bobbin and having another portion disposed in a hollow portion of the coil bobbin to be inserted in the coil bobbin, a terminal section disposed on the core and having a side surface and a lower surface, and a plurality of terminals each having a first portion electrically connected to a corresponding one of the drawn-out lines of the coil and protruding from the side surface of the terminal section, a second portion protruding from the lower surface, and a middle portion connected between the first and second portions and disposed in the terminal section.

The foregoing and/or other aspects of the present general inventive concept may also be achieved by providing an electronic apparatus thin transformer including a circuit board and a transformer disposed to be electrically and mechanically coupled to the circuit board, and the transformer having a coil bobbin around which a coil is wound, the coil having a plurality of drawn-out lines, a core having a portion disposed around the coil and the coil bobbin and having another portion disposed in a hollow portion of the coil bobbin to be inserted in the coil bobbin, a terminal section disposed on the core and having a side surface and a lower surface facing the circuit board, and a plurality of terminals each having a first portion electrically connected to a corresponding one of the drawn-out lines of the coil and protruding from the side surface of the terminal section, a second portion protruding from the lower surface, and a middle portion connected between the first and second portions and disposed in the terminal section.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
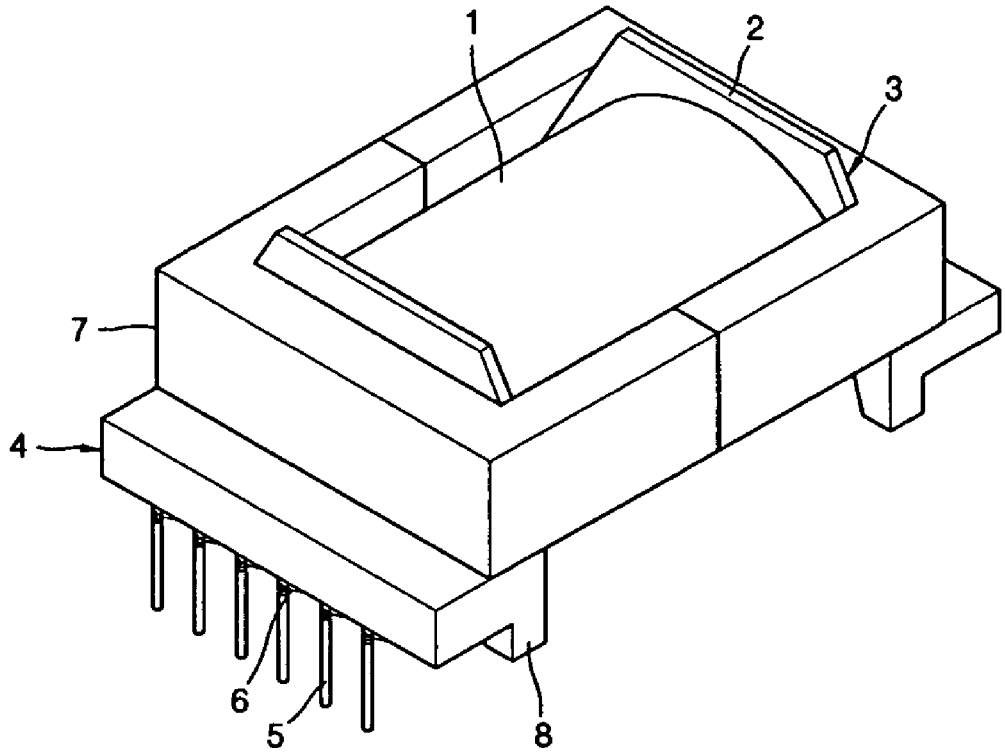
FIG. 1 (PRIOR ART)
FIG. 1 is a perspective view illustrating a conventional horizontal transformer of FIG. 1.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 3:
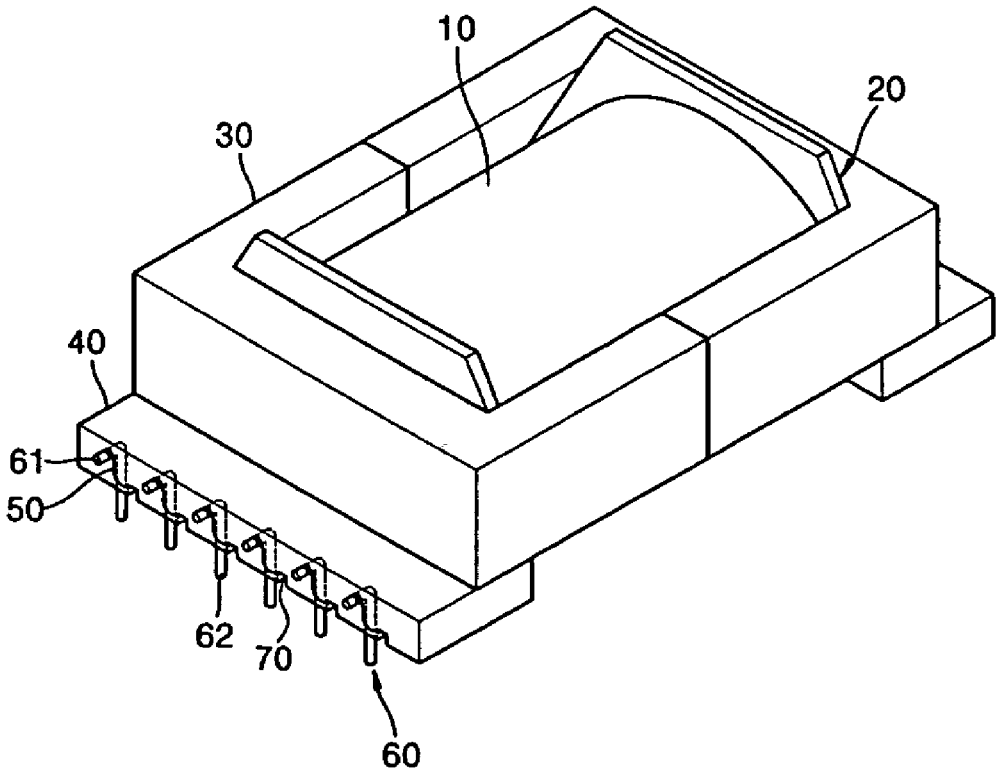
FIG. 3 is a perspective view illustrating a thin transformer according to an embodiment of the present general inventive concept.
Figure 4:
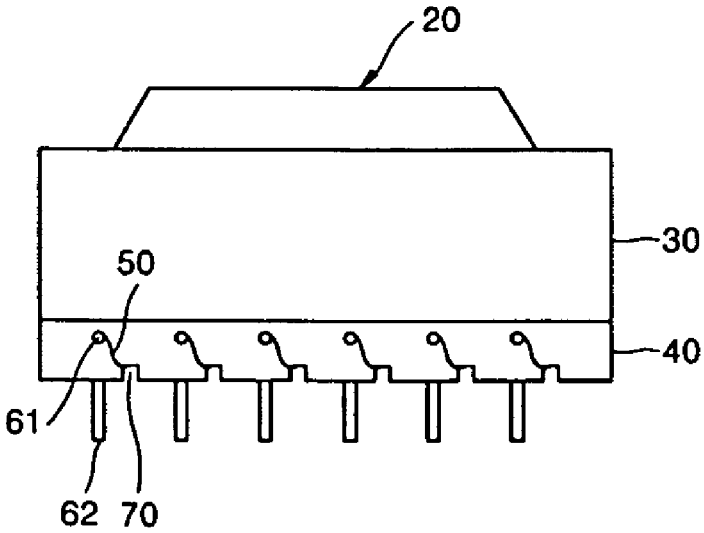
FIG. 4 is a front view illustrating the thin transformer of FIG. 3.

FIG. 3 is a perspective view illustrating a thin transformer according to an embodiment of the present general inventive concept, and FIG. 4 is a front view illustrating the thin transformer shown in FIG. 3.

As described in FIGS. 3 and 4, the thin transformer according to the present general inventive concept may include a hollow coil bobbin 20 around which a coil 10 is wound, an iron core 30 having a portion formed to pass through a portion of the coil bobbin 20 and another portion surrounding the coil bobbin 20, and a terminal section 40 provided adjacent to the coil bobbin 20 under the iron core 30.

Figure 6A:
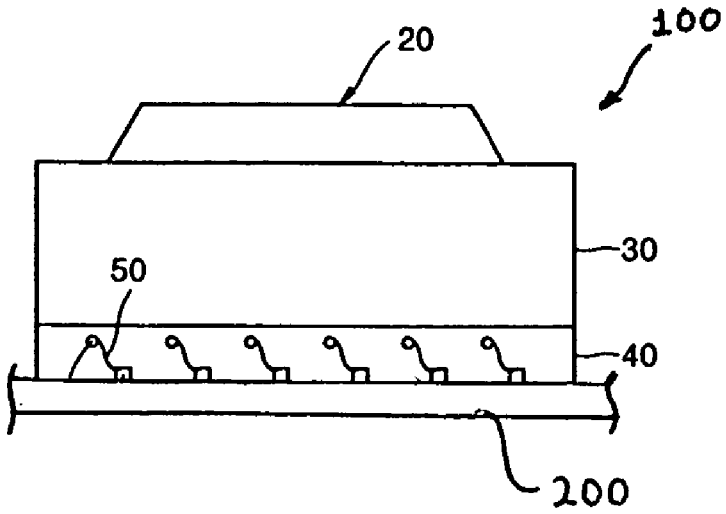
FIGS. 6A and 6B are partial side views illustrating an electronic apparatus having a circuit board and a thin transformer mounted on the circuit board according to another embodiment of the present general inventive concept.
Figure 6B:
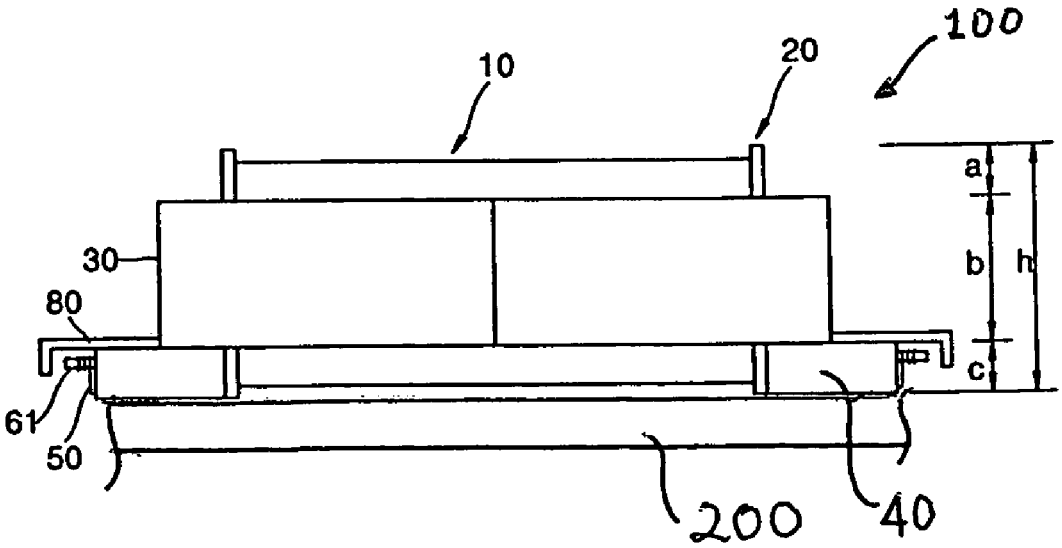

The terminal section 40 may include several terminals 60 electrically connected to drawn-out lines 50 of the coil 10 and also electrically and mechanically connected to a circuit board 200 (FIGS. 6A and 6B). The respective terminals 60 can be provided in the terminal section 40 such that a first portion 61 of each terminal 60 connected to a corresponding one of the drawn-out lines 50 is exposed at a first side (side surface) of the terminal section 60 other than a second side (lower surface) of the terminal section 60 in which a second portion 62 of the each terminal 60 is exposed downwardly to be connected to the circuit board 200. The terminal section 40 can be formed with grooves 70 through which the drawn-out lines 50 connected to the respective terminals 60 can pass.

The grooves 70 may be concave grooves formed in a lower surface of the terminal section 40 as shown in FIGS. 3 and 4, and may be holes penetrating the terminal section 40.

As shown in FIGS. 3 and 4, the first portion 61 of each terminal connected to the drawn-out line 50 can be exposed from the side surface (first side) of the terminal section 40.

In contrast to conventional straight terminals, the each terminal 60 may be a bent terminal provided such that the second portion 62 of the terminal 60 is exposed from the lower surface (second side) of the terminal section 40 and the first portion 61 of the terminal 60 is exposed from the side surface (first side) of the terminal section 40. The each terminal 60 may have a middle portion disposed between the first and second portions 61 and 62 and bent in directions toward the first and second portions 61 and 62, respectively.

Figure 5:
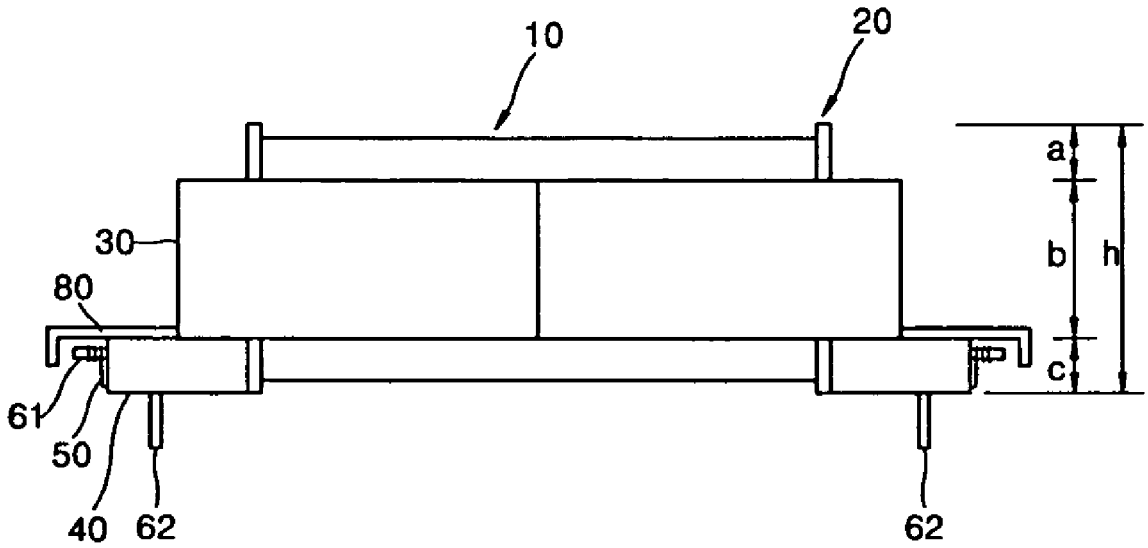
FIG. 5 is a side view illustrating a thin transformer according to another embodiment of the present general inventive concept.

FIG. 5 is a side view illustrating a thin transformer according to another embodiment of the present general inventive concept. As shown in FIGS. 3 through 5, a cover 80 can be employed to cover the first portions 61 of the terminals 60 connected to the drawn-out lines 50 to protect connection portions of the drawn-out lines 50 and the terminals 60.

The embodiments of the present general inventive concept can be applied to a horizontal transformer in which the coil bobbin 20 is provided horizontally with respect to the circuit board 200 to decrease a height of a transformer as described in FIGS. 3 and 5, but the embodiments of the present invention may also be applied to a vertical transformer in which the coil bobbin 20 is provided vertically with respect to the circuit board 200.

The iron core 30 may be provided by coupling two "E" shaped iron cores to be disposed opposite to each other, and may be provided by coupling an "E"-shaped iron core and an "I"-shaped iron core.

Referring to FIG. 5, a total height h of the transformer provided on a circuit board can be determined according to three factors of a height "a" above the iron core 30, a height "b" of the iron core 30, and a height "c" below the iron core 30. Since the height "b" of the iron core 30 is determined according to a capacity of the transformer, the height "b" has little room to be decreased. Since the height "a" above the iron core 30 is dependent upon the number of windings of the coil 10 which is determined from the capacity of the transformer, the height "a" also has little room to be decreased similarly to the height "b" of the iron core 30. Accordingly, the total height "h" of the transformer may be decreased by decreasing the height "c" which is associated with the terminal section 40.

Figure 2:
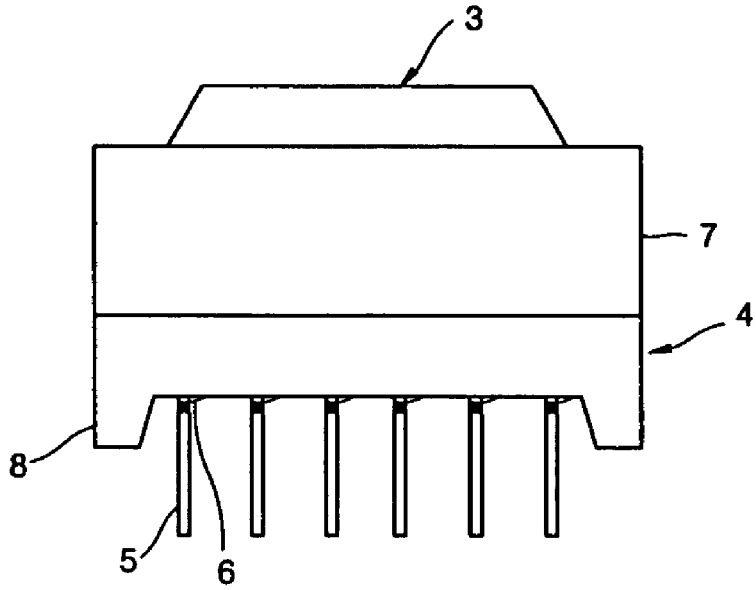
FIG. 2 (PRIOR ART)
FIG. 2 is a front view illustrating the conventional horizontal transformer.

As shown in FIGS. 1 and 2, drawn-out lines 6 and terminals 5 are connected at a lower portion of the terminal section 4. However, the drawn-out lines 50 and the terminals 60 of FIGS. 3 through 5 are connected at the side surface of the terminal section 40 according to the embodiment of the present general inventive concept. Accordingly, since the space conventionally required for connection of the drawn-out lines 6 and the terminals 5 and secured by the protruding portion 8 of FIGS. 1 and 2 can be excluded from the lower portion of the terminal section 4, it is possible to decrease the total height of the transformer as much.

FIGS. 6A and 6B are partial side views illustrating an electronic apparatus 100 having the circuit board 200 and the thin transformer of FIGS. 3 and 4 or 5. The thin transformer of FIGS. 6A and 6B may be identical to those of FIGS. 3 through 5, respectively. Thus, repeated descriptions of identical parts will be omitted.

Further, since the terminals 60 are not formed in a straight line shape but in a bent shape, even a small thickness of the terminal section 40 can provide a sufficient mechanical strength to the terminals 60, so that the thickness of the terminal section 40 can be decreased.

As described above, according to the thin transformer according to the present general inventive concept, it is possible to decrease the total height of the transformer to the height required for connection between the drawn-out lines and the terminals. Further, since the thickness of the terminal section required for securing the mechanical strength of the terminals can be decreased, it is possible to decrease the total height of the transformer. Therefore, according to the present invention, it is possible to decrease the thickness of the transformer, and it is thus possible to accomplish the decrease of the thickness and size of the electronic apparatus in which the transformer is used.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A thin transformer comprising:

a hollow coil bobbin around which a coil is wound, the coil having drawn-out lines;

an iron core provided to pass through a hollow portion of the coil bobbin;

a terminal section including a plurality of terminals electrically connected to the drawn-out lines of the coil, the terminal section electrically and mechanically connected to a circuit board and disposed adjacent to the coil bobbin below the iron core, each of the terminals including a first portion connected to the drawn-out lines and exposed from a side surface of the terminal section other than a lower surface of the terminal section from which a second portion of the terminal is exposed to the circuit board, and the terminal section includes grooves through which the drawn-out lines connected to the side surface of the respective terminals can pass; and a protection cover extending from the side surface of the terminal section to cover the first portions of the terminals connected to corresponding ones of the drawn-out lines and to protect the side surface of the terminal section.

2. The thin transformer according to claim 1, wherein the drawn-out lines are exposed from the side surface of the terminal section.

3. The thin transformer according to claim 1, wherein each terminal is formed of a bent shape having one end portion exposed from the lower surface of the terminal section and the other end portion exposed from the side surface of the terminal section.

4. A thin transformer used with an electronics apparatus having a circuit board, comprising:

a coil bobbin around which a coil is wound, the coil having a plurality of drawn-out lines;

a core having a portion disposed around the coil and the coil bobbin, and having another portion disposed in a hollow portion of the coil bobbin to be inserted in the coil bobbin;

a terminal section disposed below the core and having a side surface and a lower surface;

a plurality of holes penetrating through the side surface of the terminal section through which the plurality of drawn-out lines extend; and a plurality of terminals each having a first portion electrically connected to a corresponding one of the drawn-out lines of the coil and protruding from the side surface of the terminal section, a second portion protruding from the lower surface, and a middle portion connected between the first and second portions and disposed in the terminal section.

5. The thin transformer according to claim 4, wherein the lower surface of the terminal section faces a circuit board, and the side surface forms an angle with the lower surface.

6. The thin transformer according to claim 4, wherein the side surface of the terminal section faces outside in a direction having an angle with the lower surface of the terminal section.

7. The thin transformer according to claim 4, wherein the first portion of each terminal is substantially parallel to the lower surface of the terminal section, and the second portion of the each terminal is substantially parallel to the side surface.

8. The thin transformer according to claim 4, wherein the first portion of each terminal protrudes in a direction substantially perpendicular to the side surface, and the second portion of the each terminal protrudes in another direction substantially perpendicular to the lower surface of the terminal section.

9. The thin transformer according to claim 4, wherein the middle portion of each terminal is bent.

10. The thin transformer according to claim 4, wherein the middle portion of each terminal is buried in the terminal section.

11. The thin transformer according to claim 4, wherein the terminal section comprises a pair of sub-sections disposed on both sides of the core opposite to each other with respect to the core bobbin and each having the side surface and the lower surface, and the terminals are disposed on a corresponding one of the sub-sections.

12. The thin transformer according to claim 11, wherein the side surfaces of the sub-sections are disposed to face outside in opposite directions, and the lower surfaces of the sub-sections are disposed to face in the same direction.

13. The thin transformer according to claim 4, wherein the terminal section has a cross-section of a rectangular shape having two sides opposite to the side surface and the lower surface, respectively.

14. The thin transformer according to claim 4, wherein the plurality of holes formed on the side surface of the terminal section correspond to each of the first portions of the terminals and comprise a hole portion to accommodate and surround the corresponding drawn-out line and a thin curved slit extending from the lower surface of the terminal portion to the hole portion.

15. The thin transformer according to claim 4, wherein the drawn-out lines are substantially enclosed by the terminal section.

16. The thin transformer according to claim 4, wherein the electronics apparatus comprises a circuit board having a major surface, and the lower surface is disposed parallel to the major surface of the circuit board so that the thin transformer is disposed to be electrically and mechanically connected to the circuit board.

17. The thin transformer according to claim 15, wherein the side surface of the terminal section is perpendicular to the major surface of the circuit board.

18. An electronic apparatus comprising:

a circuit board; and a transformer disposed to be electrically and mechanically coupled to the circuit board, the transformer comprising, a coil bobbin around which a coil is wound, the coil having a plurality of drawn-out lines, a core having a portion disposed around the coil and the coil bobbin, and having another portion disposed in a hollow portion of the coil bobbin to be inserted in the coil bobbin, a terminal section disposed below the core and having a side surface and a lower surface facing the circuit board, and a plurality of terminals each having a first portion protruding from the side surface of the terminal section, a second portion protruding from the lower surface, and a middle portion connected between the first and second portions and disposed in the terminal section, wherein the drawn-out lines extend from the coil through the terminal section without being exposed at the lower surface of the terminal portion to be electrically connected to the corresponding first portions of the terminals.

19. The thin transformer according to claim 18, wherein the lower surface of the terminal section faces the circuit board, and the side surface forms an angle with the lower surface.

20. The thin transformer according to claim 18, wherein the lower surface is disposed parallel to a major surface of the circuit board, and the side surface of the terminal section is perpendicular to the major surface of the circuit board.

21. A transformer usable with an electronics apparatus, the transformer comprising:

a coil bobbin;

an iron core disposed in the coil bobbin;

a coil wound around the coil bobbin;

at least one terminal section disposed at an end of the coil bobbin and having a plurality of concave recess portions disposed at a lower surface thereof and a plurality of slit portions extending upward from the corresponding concave recess portions to accommodate drawn out lines of the coil; and a plurality of terminals having vertical portions extending from the lower surface of the at least one terminal section and horizontal portions extending from a side surface of the at least one terminal section such that drawn out lines from the coil are wound around the horizontal portions of the plurality of terminals.

22. The transformer according to claim 21, wherein each of the plurality of terminals have an "L" shape extending through the at least one terminal section.

* * * * *